US008939160B2

(12) United States Patent
Falcucci

(10) Patent No.: US 8,939,160 B2
(45) Date of Patent: Jan. 27, 2015

(54) MASKING DEVICE FOR COSMETIC HAIR TREATMENT

(71) Applicant: Angela Falcucci, Boston, MA (US)

(72) Inventor: Angela Falcucci, Boston, MA (US)

( * ) Notice: Subject to any disclaimer, the term of this patent is extended or adjusted under 35 U.S.C. 154(b) by 0 days.

(21) Appl. No.: 13/875,513

(22) Filed: May 2, 2013

(65) Prior Publication Data

US 2013/0291885 A1 Nov. 7, 2013

Related U.S. Application Data

(60) Provisional application No. 61/687,828, filed on May 2, 2012.

(51) Int. Cl.

| | |
|---|---|
| ***A45D 19/18*** | (2006.01) |
| ***A45D 2/00*** | (2006.01) |
| ***A45D 19/00*** | (2006.01) |

(52) U.S. Cl.

CPC ..... *A45D 19/0025* (2013.01); *A45D 19/008* (2013.01); *A45D 19/0016* (2013.01)

USPC ..... 132/270; 132/222

(58) Field of Classification Search

CPC ..... A45D 19/0025; A45D 19/00; A45D 19/0008; A45D 19/18; A45D 19/0016; A45D 2019/0066; A45D 2019/0083; A45D 2019/0091

USPC ..... 132/270, 208, 222, 210, 223, 240, 241, 132/243, 245, 246, 247, 55, 319, 54, 108, 132/273, 274; D28/4–7, 10, 20, 99, 32, 33, D28/37; 2/171, DIG. 11; 401/11, 9, 10

See application file for complete search history.

(56) References Cited

U.S. PATENT DOCUMENTS

| | | | | | |
|---|---|---|---|---|---|
| 1,612,911 | A | | 1/1927 | Durnerin | |
| 1,643,035 | A | | 9/1927 | Stahl | |
| 1,824,883 | A | | 9/1931 | Fulton | |
| 1,951,658 | A | | 3/1934 | Humphrey | |
| 1,994,099 | A | | 3/1935 | Fulton | |
| 2,041,641 | A | | 5/1936 | Grasso | |
| 2,106,326 | A | * | 1/1938 | McFadden | 132/243 |
| 2,144,829 | A | * | 1/1939 | Bowyer | 132/241 |
| 2,151,024 | A | * | 3/1939 | Gilbert | 428/311.11 |
| 2,151,692 | A | | 3/1939 | Evans et al. | |
| 2,166,386 | A | | 7/1939 | Auster | |
| 2,720,207 | A | | 10/1955 | Burtnett | |
| 2,783,474 | A | * | 3/1957 | Campagna et al. | 2/171 |
| 3,548,842 | A | | 12/1970 | McCall | |
| 4,196,741 | A | | 4/1980 | Minghenelli | |
| 4,637,411 | A | | 1/1987 | Sanders | |
| 4,672,983 | A | * | 6/1987 | Nath et al. | 132/208 |
| 4,962,775 | A | | 10/1990 | Squatrito | |
| 5,287,864 | A | | 2/1994 | Gallo | |
| 5,303,723 | A | * | 4/1994 | Schach | 132/246 |
| 5,335,679 | A | | 8/1994 | Baxter | |
| 5,494,059 | A | * | 2/1996 | Barrows et al. | 132/273 |
| 5,535,764 | A | * | 7/1996 | Abramson | 132/200 |
| 5,598,585 | A | * | 2/1997 | Stroup | 2/171 |
| 5,662,128 | A | | 9/1997 | Habibi | |
| 5,664,590 | A | | 9/1997 | Plateroti et al. | |

(Continued)

*Primary Examiner* — Vanitha Elgart

(74) *Attorney, Agent, or Firm* — Bergman & Song LLP; Michael Bergman

(57) ABSTRACT

A masking sheet for hair coloring has first and second surfaces encompassed by first and second longitudinal edges and first and second transverse edges where the first and second transverse edges embody respective substantially convex curves.

4 Claims, 11 Drawing Sheets

(56) References Cited

U.S. PATENT DOCUMENTS

| | | | | |
|---|---|---|---|---|
| 5,799,669 | A * | 9/1998 | Briggs | 132/208 |
| 5,799,672 | A * | 9/1998 | Hansbury | 132/273 |
| 5,810,024 | A * | 9/1998 | Crites | 132/210 |
| 5,816,268 | A | 10/1998 | Awaijane | |
| 5,867,833 | A * | 2/1999 | LeDonne | 2/171 |
| 5,988,183 | A * | 11/1999 | Huang | 132/273 |
| 6,863,076 | B2 | 3/2005 | Russell | |
| 7,305,995 | B2 | 12/2007 | Tojo et al. | |
| 7,789,093 | B2 | 9/2010 | Tojo et al. | |
| 7,963,291 | B2 | 6/2011 | Tojo et al. | |
| 8,033,286 | B2 * | 10/2011 | Perry | 132/270 |
| 8,069,863 | B2 | 12/2011 | Bird | |
| 8,132,576 | B1 * | 3/2012 | Trottier | 132/270 |
| 2004/0118424 | A1 | 6/2004 | Russell | |
| 2004/0231689 | A1 | 11/2004 | Kobayashi et al. | |
| 2007/0119473 | A1 * | 5/2007 | Russell | 132/222 |
| 2008/0083420 | A1 * | 4/2008 | Glenn et al. | 132/208 |
| 2008/0105275 | A1 | 5/2008 | Wilkins | |
| 2008/0223391 | A1 * | 9/2008 | Baker et al. | 132/202 |
| 2009/0139538 | A1 | 6/2009 | Cheung | |
| 2010/0139684 | A1 | 6/2010 | Smith et al. | |
| 2011/0073129 | A1 | 3/2011 | Russell | |
| 2011/0132390 | A1 | 6/2011 | Jacob | |

* cited by examiner

MASKING DEVICE FOR COSMETIC HAIR TREATMENT

CROSS-REFERENCE TO RELATED APPLICATIONS

The present application is a nonprovisional application which claims the benefit of U.S. provisional patent application No. 61/687,828 filed on May 2, 2012 the disclosure of which is herewith incorporated by reference in its entirety.

FIELD OF THE INVENTION

The present invention relates to the cosmetic treatment of hair and more particularly to the masking of hair for localized treatment of particular regions of hair.

BRIEF DESCRIPTION OF THE DRAWINGS

Various advantages and features of the invention will be more readily understood in relation to the following detailed description of the invention, which is provided in conjunction with the accompanying drawings.

It should be noted that, while the various figures show respective aspects of the invention, no one figure is intended to show the entire invention. Rather, the figures together illustrate the invention in its various aspects and principles. As such, it should not be presumed that any particular figure is exclusively related to a discrete aspect or species of the invention. To the contrary, one of skill in the art would appreciate that the figures taken together reflect various embodiments exemplifying the invention.

DESCRIPTION

Figure 1:
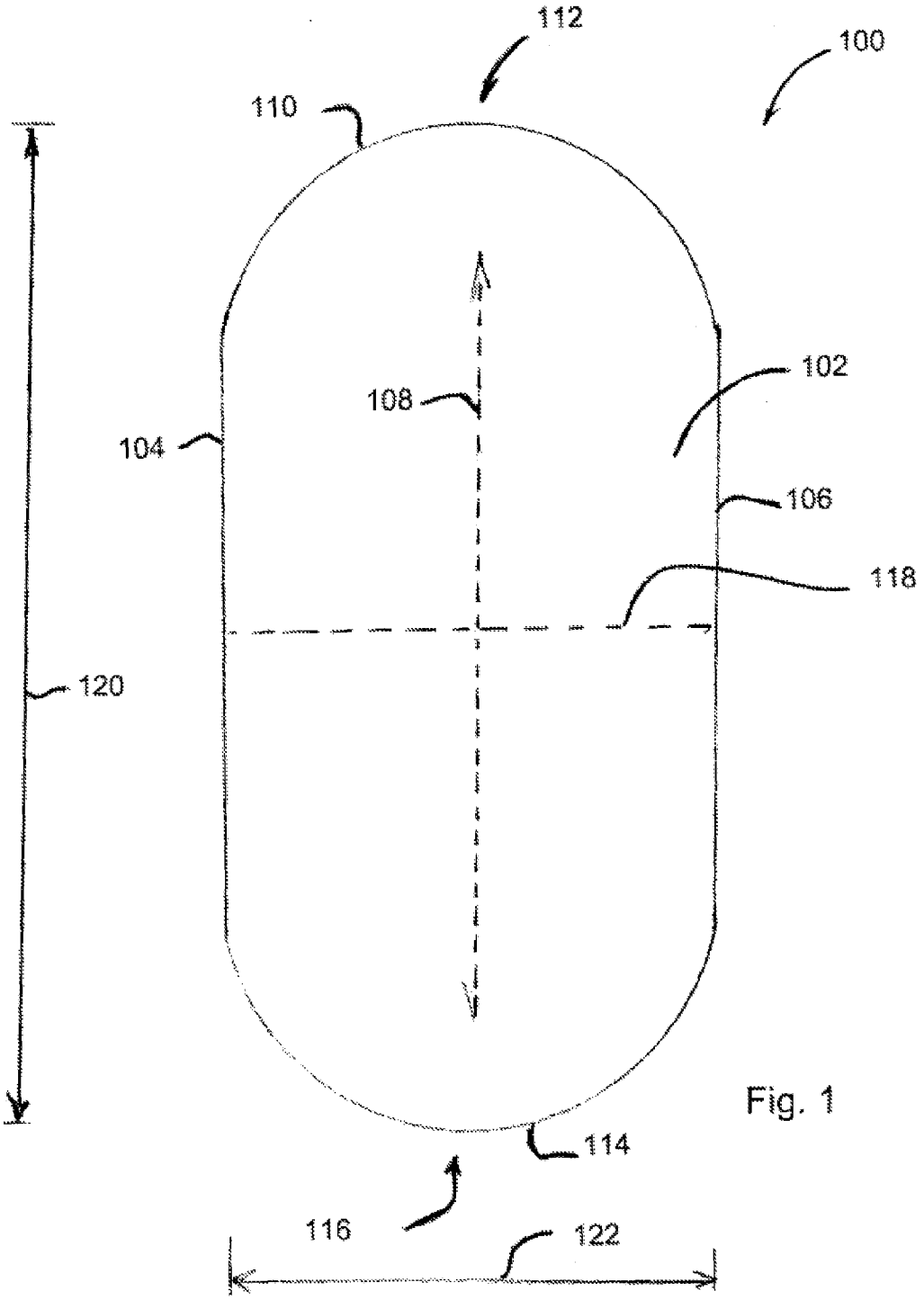
FIG. 1 shows, in schematic form, a masking sheet according to principles of the invention.

This application is directed to the technology of hair treatment in its various forms including, but not limited to, the cosmetic application of colorant. In particular, a hair treatment formulation may be applied to a limited region of a subject's hair by the selective masking of the hair with a masking sheet.

The treatment of hair to increase its attractiveness, that is for cosmetic purposes, has been known for centuries, if not millennia. Not withstanding this long history it is well understood that innovation is ongoing in the field of cosmetic hair treatment. New hairstyles, shades and methods of coloring, as well as methods of frosting, curling, crimping and waving regularly emerge. Developing such innovations represents a huge and ongoing enterprise, and one where the pool of novel ideas is clearly far from exhausted. In this environment, the present inventor has created devices and methods of substantial novelty and significant commercial value. She has done this by careful analysis and understanding of the existing art and its historical basis, and by the application of careful and creative thought to synthesize a masking method and device that represents an important advancement over those previously in existence.

Masking hair for the application of liquid colorants, and like compositions, has been considered in various previous forms. For example, U.S. Pat. No. 4,637,411 to Sanders, (incorporated by reference herewith in its entirety) describes a hairdresser's masking sheet with a flexible substrate and a securing material. More recently, US published patent application number 2004/0118424 to Russell, (incorporated by reference herewith in its entirety) describes a foil for use in hair coloring made of a substantially rectangular sheet of material where an upper edge of the foil is pinked, forming a zigzag pattern.

In contrast to these and other examples of the previous technology, a masking sheet prepared according to principles of the present invention includes at least one curved edge configured to allow the masking sheet to conform more readily to the curvature of a client's head. The term masking sheet is used herein to designate a masking device formed to include any of the wide variety of materials and configurations including, without limitation, a metallic material (such as, e.g., a metallic foil), a natural polymer, a synthetic polymer and a paper, among other possibilities. Among possible metallic materials, are included a variety of metals and metallic alloys including, without limitation, an aluminum metal and an aluminum alloy. Synthetic and natural polymers adapted for use in the invention include, without limitation, polyethylene, polyurethane, polystyrene, polypropylene, ABS plastic and polybutylene, among others. Other appropriate materials include, without limitation, various papers including papyrus, wood paper and rice paper and other cellulose products as well as various animal materials including animal skin. In certain embodiments, the masking sheet will include a substantially porous material. In other embodiments, the masking sheet will include a substantially non-porous material. In certain embodiments, the masking sheet will include a polymer foam material.

FIG. 1 shows, in schematic form, a masking sheet 100 prepared according to principles of the invention. The masking sheet of the exemplary embodiment exhibits a first surface 102 order by first 104 and second 106 longitudinal edges. Longitudinal edges 104, 106 are disposed generally parallel to a longitudinal axis 108 of the masking sheet. A further edge 110 is disposed between longitudinal edges 104 and 106 and defines a first end 112 of the masking sheet 100. Another edge 114 is disposed between edges 104 and 106 and formed a second end 116 disposed in spaced relation to first end 112.

Edges 114 and 116 define substantially convex curves with respect to the surface 102 and, according to principles of the invention readily assume bi-convex configuration in three-space where, in use, flexibility of the masking sheet allows a curvature of the masking sheet 100 about longitudinal axis 108. In certain embodiments, the masking sheet 100 is flexible enough so that it can be folded about a line 118 that is generally perpendicular to longitudinal axis 108 and roughly midway between the first 112 and second 116 ends.

In various embodiments, an overall length 120 of the masking sheet 100 between first 112 and second 116 ends will be chosen according to the requirements of a particular application. Exemplary values will include, 1 inch, 2 inches, 3 inches, 4 inches, 5 inches, 6 inches, 7 inches, and 8 inches. Other values, including various intermediate lengths, will fall within the scope of the invention. Likewise, widths 122 for various embodiment of the invention will range between about 1 inch and about 6 inches, although other dimensions again fall within the scope of the invention.

Figure 2:
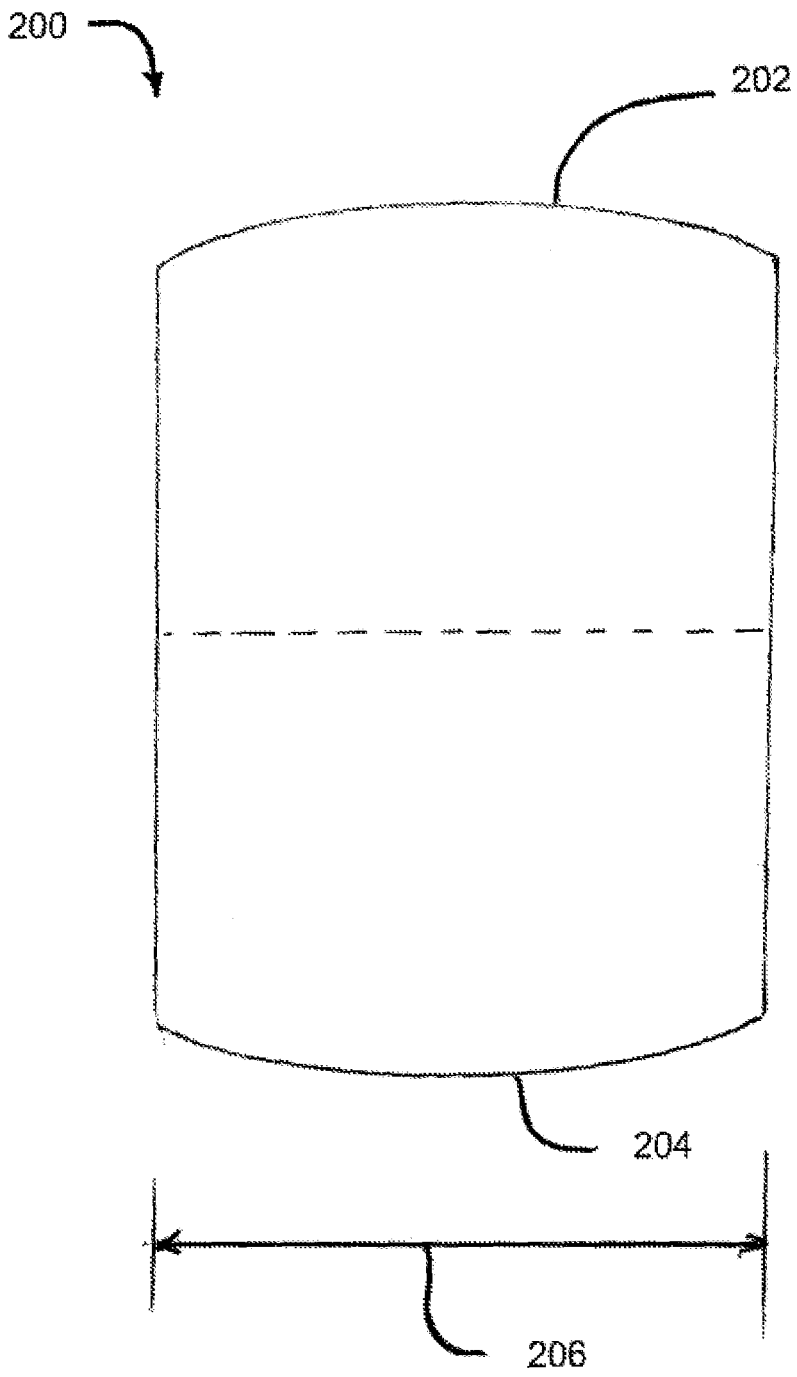
FIG. 2 shows, in schematic form, a further masking sheet according to principals of the invention.

As illustrated in FIG. 1, edges 114 and 116 include substantially semicircular curved regions having a diameter approximately equal to the width dimension 122 of the masking device 100. Other embodiments of the invention will exhibit alternative curvatures. Thus, for example, FIG. 2 shows the masking device 200 including generally opposed curved ends 202, 204 having a flatter aspect that is generally elliptical (i.e. with a longitudinal axis of the ellipse disposed generally perpendicular to a longitudinal axis of the masking device). In another embodiment, such a flatter aspect is provided by having a circular curvature with a diameter substantially larger than a width dimension 206 of the masking device 200. In other embodiments, the masking device will have an elliptical curvature such that the ellipse has a longitudinal axis disposed substantially parallel to a longitudinal axis of the masking device. In other embodiments of the invention, an elliptical edge will have a longitudinal elliptical axis at an oblique angle with respect to a longitudinal axis of the masking device.

Still further embodiments of the invention will include a generally polygonal edge such as, for example, a triangular edge, a pentagonal edge, a hexagonal edge, a heptagonal edge, an octagonal edge or any other polygonal form adapted to provide a generally convex edge according to principals of the invention. Generally, such embodiments will include a corresponding opposed edge of the same polygonal form. However, alternative embodiments are possible and within the scope of the invention that combine edges of various forms on opposite ends of a single masking device.

Figure 3:
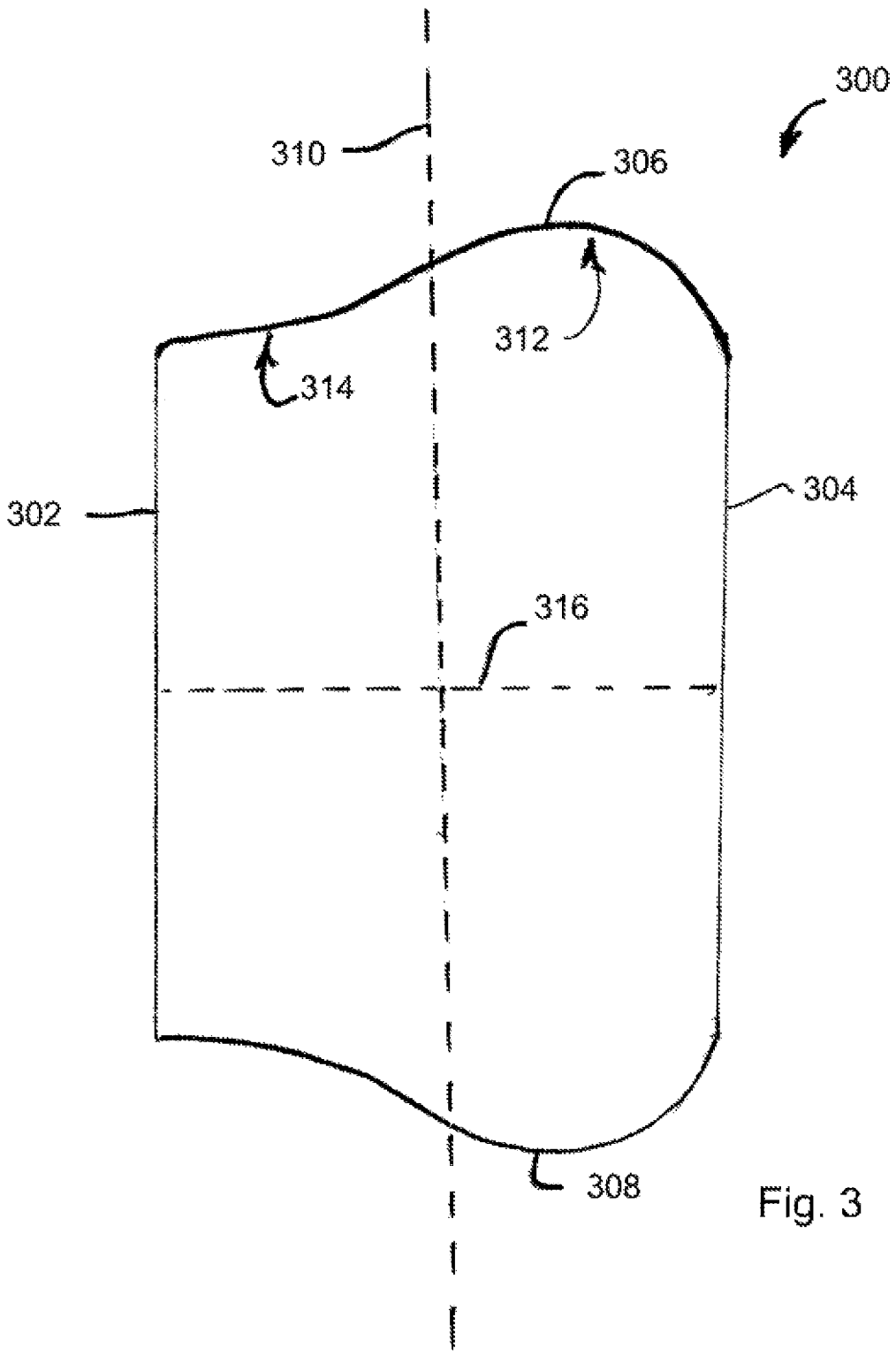
FIG. 3 shows, in schematic form, a still further masking sheet according to principles of the invention.

FIG. 3 shows a further embodiment of the invention including a masking sheet 300 with first and second longitudinal ends 302, 304 and transverse ends 306, 308. As illustrated, transverse ends 306, 308 are asymmetrical with respect to a longitudinal centerline 310 of the masking sheet 300. Thus, a first region 312 of exemplary transverse end 306 exhibits a curve of larger convexity than that of a second region 314. In the illustrated embodiment, the ends are substantially symmetrical about a transverse centerline 316 of the masking sheet 300.

Figure 4:
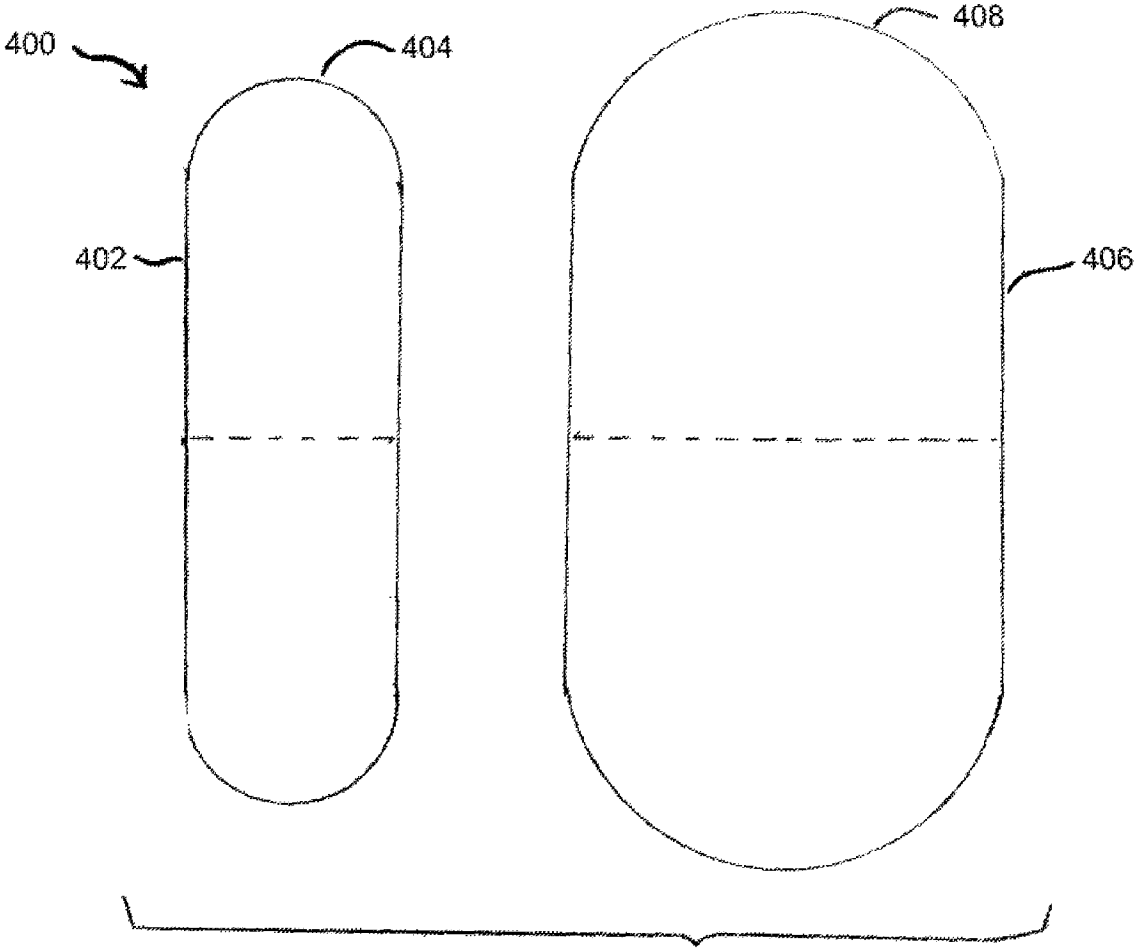
FIG. 4 shows, in schematic form, a portion of a kit including a plurality of masking sheets according to principles of the invention.

In certain embodiments, masking sheets will be provided in a kit, where the kit includes masking sheets in an assortment of sizes. Correspondingly, FIG. 4 shows, in schematic form, a portion of a masking sheet kit 400. The masking sheet kit 400 includes at least one masking 402 sheet having a generally convex end 404 and a second larger masking sheet 406 having a further generally convex end 408. One of skill in the art will appreciate that a wide variety of different configurations and quantities of masking sheets may be included in such a kit, and that various kits will be beneficially marketed according to the demands of the marketplace.

Figure 11:
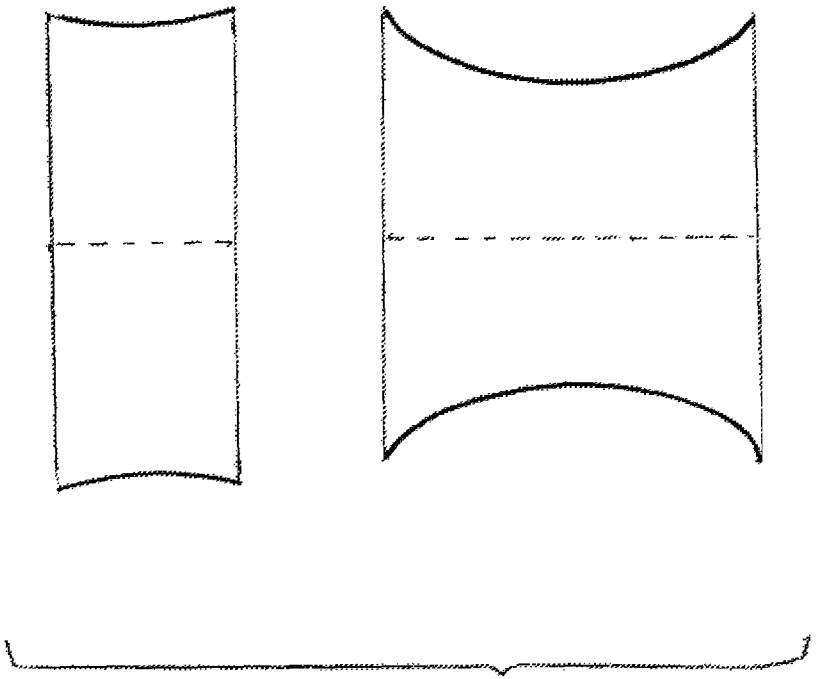
FIG. 11 shows in schematic form, a portion of a kit including a plurality of masking sheets according to principles of the invention.

In additional embodiments of the invention, convex end curves may also be employed. Further, monotonically convex and/or monotonically concave curvatures (as shown in FIG. 11) will be beneficially employed in certain embodiments of the invention. As noted above, the curvatures of opposing ends need not be identical, although they will certainly be substantially similar in some embodiments.

Figure 5:
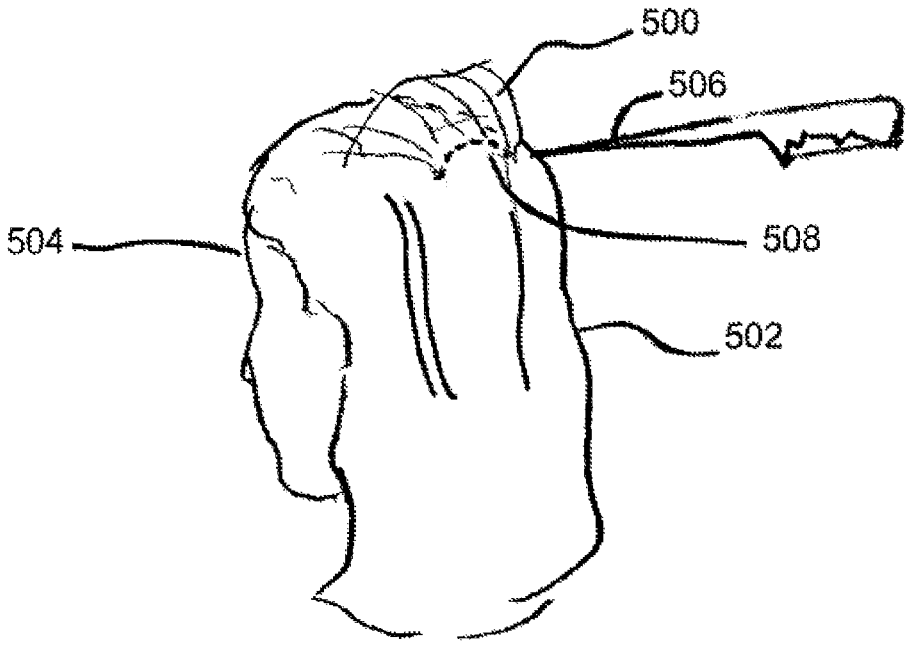
FIGS. 5-10 show, in schematic form, various aspects of a method of treating hair according to principals of the invention.
Figure 6:
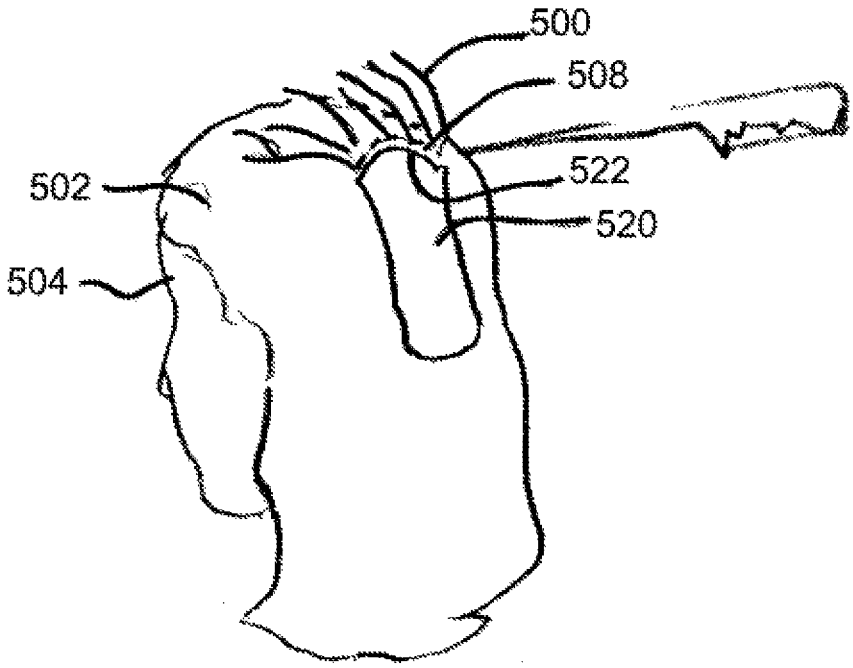
Figure 7:
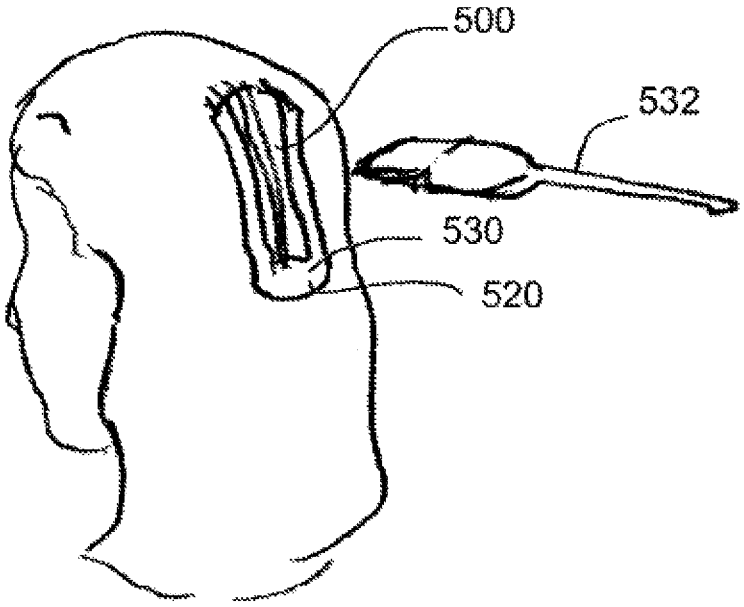

FIGS. 5-7 illustrate a method according to principles of the invention including the application of a masking device having an arcuate edge during hair treatment. FIG. 5 shows the activity of selecting a portion 500 of the hair 502 of a client 504 for treatment using, for example, a conventional hair pick 506. The portion 500 is selected along an arcuate line 508. That is, the selected hair includes strands of hair, the roots of which are generally proximate to the arcuate line 508. By selecting and masking hair along such an arcuate line 508 more efficient masking may be achieved, as compared with conventional straight line masking. The selected hair portion 500 is elevated and folded away from the arcuate line 508, in the manner illustrated.

FIG. 6 shows a subsequent activity with respect to treating the hair 502 of the client 504. The hair portion 500 is held out of the way, and a masking sheet 520 is arranged such that an arcuate edge 522 of the sheet 520 is aligned with and disposed generally adjacent to the scalp of the client 504 at the previously exposed arcuate line 508.

FIG. 7 shows a subsequent activity with respect to treating the hair 502 of the client 504. While the masking sheet 520 is held in place, the previously elevated hair portion 500 is released and disposed adjacent to an outer surface 530 of the masking sheet 520. The hair portion 500 is moved into place and a treatment composition such as, for example, a liquid chemical composition, a powdered or chemical composition, a gel chemical composition, or any other appropriate material is applied to the hair portion 500. In the illustrated example, the treatment composition is applied with a brush 532, however any other useful method of applying the treatment composition is intended to come within the scope of the invention including, without limitation, spraying, rolling and pouring. As a result of this application of treatment composition, the hair portion 500 is treated and/or coated with the treatment composition.

In various embodiment of the invention, the treatment composition will include a hair bleaching composition, a hair dying composition, a hair straightening composition, a hair curling composition, a hair frosting composition, a hair highlighting composition and any other useful hair treatment composition including a composition selected to serve any combination of the functions identified above and/or other functions. In certain embodiments of the invention, the composition will have an adherent effect so as to cause the hair portion 502 to be removably adhered to surface 530 of masking sheet 520.

In various embodiments of the invention, the masking sheet 520 will be substantially impermeable to the composition. In other embodiments of the invention, the masking sheet will include absorbent portion adapted to absorb at least some of the treatment composition. In still further embodiments of the invention, the masking sheet will include both absorbent and substantially impermeable materials. In certain embodiments, the adherent characteristics of the treatment composition and the masking sheet, as well as of the hair portion, tend to hold the masking sheet in its folded orientation with respect to the hair portion 500.

Figure 8:
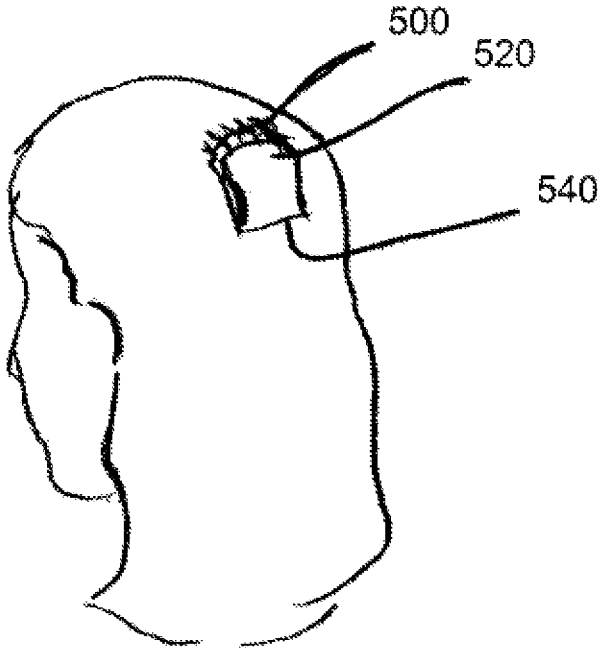

FIG. 8 shows a subsequent activity according to principles of the invention. As shown in FIG. 8, the masking sheet 520 is folded along a line 540 so as to generally enclose and cover the coated portion 500 of the hair. Where the masking sheet 520 includes a substantially impermeable portion, the treatment composition will be substantially contained within the folded region between, and adjacent hair will, for the most part, be left unaffected by the portion of the treatment composition disposed within the folded masking sheet.

In certain embodiments, the masking sheet 520 will be maintained in a folded configuration by an adherent characteristics of the treatment composition with respect to the masking sheet and/or the client's hair. In some embodiments and external mechanical clip will be applied to assist in maintaining the folded configuration of the masking sheet. In further embodiments, the masking sheet will include a material that tends to acquire a static electric charge which will serve to further maintain the masking sheet in its folded configuration. In still further configurations, the masking sheet will include a further adherent material such as, for example, a mild adhesive, adapted to hold the masking sheet in its folded configuration.

In additional embodiments, the masking sheet will include a magnetic device such as, for example, a permanent magnet and/or an electromagnet arranged and configured to hold the masking sheet in its folded configuration. In yet further embodiments, the masking sheet will include a portion having a rheological characteristic such that the sheet will tend to maintain a folded configuration once folded. In still further configurations of the invention, folding of the sheet will cause a physical and/or chemical characteristic of the sheet to change in response to folding so as to assist the sheet in maintaining a folded configuration once folded. In certain embodiments, the sheet will include a mechanical feature such as a snap device, a zipper device, a spring device, a hook and loop device, or other mechanical device, adapted to maintain the masking sheet in a folded configuration once folded. The creative practitioner of ordinary skill in the art will appreciate that any other feature that is known or becomes known and is appropriate to maintain the masking device in a folded configuration once folded may be advantageously employed in a corresponding embodiment of the invention.

Figure 9:
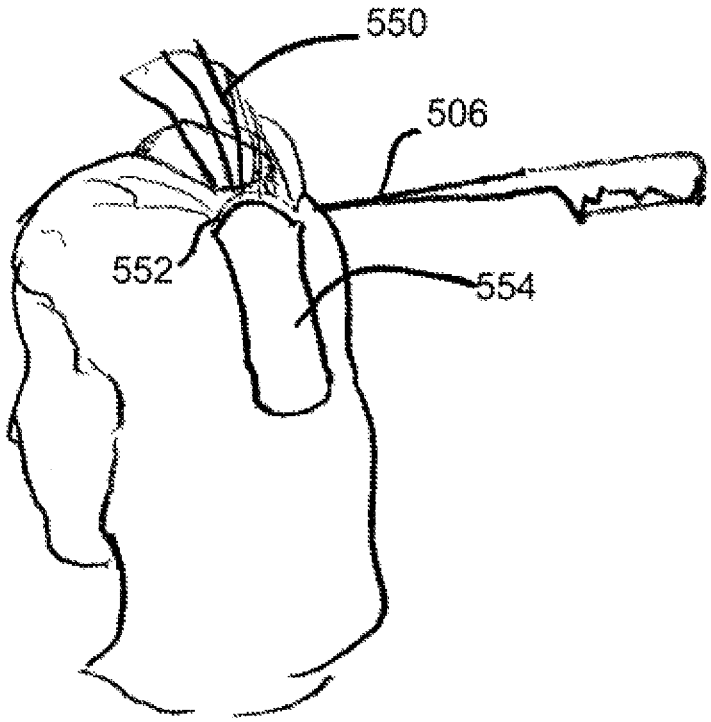
Figure 10:
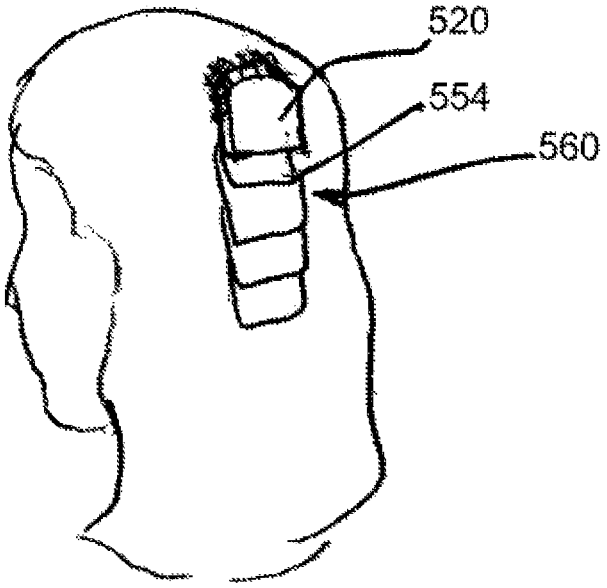

FIG. 9 shows a subsequent activity according to principles of the invention. As shown in FIG. 9, the folded masking sheet 520 can be temporarily pivoted out of the way of further activities. Thereafter, an additional hair portion 550 can be elevated using hair pick 506 to define a further arcuate line 552. A further masking sheet 554 can be aligned with and disposed adjacent to further arcuate line 552 and a fashion that repeats the previous steps. Repeating the balance of the steps, and further iterations of the same, will result in a plurality of folded masking sheets being adherently coupled to respective hair portions. FIG. 10 shows a plurality of masking sheets 560 including masking sheets 520 and 554, discussed above.

One skill the art will appreciate that additional masking sheets will be applied according to the artistic sensibilities of the hairdresser and the desires of the client. It will further be understood that the treatment, composition used may vary from client to client, and within the treatment applied to a single client, depending on the desired effect.

It will also be understood that the masking sheet will generally be removed upon completion of the hair treatment. The masking sheet may retain its folded configuration upon removal, or may resume an unfolded configuration. In certain embodiments, the masking sheet will be recyclable and/or reusable. In other embodiments, the masking sheet will be disposable.

While the exemplary embodiments described above have been chosen primarily from the field of the treatment of hair on a human head, one of skill in the art will appreciate that the principles of the invention are equally well applied, and that the benefits of the present invention are equally well realized in a wide variety of other applications including, for example, the treatment of other human hair and of the hair of other living animals as well as various textile applications including fibrous materials bearing some resemblance to hair. Further, while the invention has been described in detail in connection with the presently preferred embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Accordingly, the invention is not to be seen as limited by the foregoing description, but is only limited by the scope of the appended claims.

The invention claimed is:

1. A masking sheet comprising:

a substantially flexible material member having a first surface adapted to be disposed adjacent to a portion of a client's hair, said first surface being encompassed by first and second longitudinal edges and first and second transverse edges and contiguous therewithin, said first and second longitudinal edges being substantially rectilinear and substantially parallel to one another, said first and second transverse edges defining respective first and second monotonically convex curves with respect to a transverse centerline of said masking sheet, said first and second transverse edges defining opposite ends, and substantially exhibiting mirror symmetry, across said transverse centerline of said masking sheet, said masking sheet being adapted to be folded along a transverse fold line so as to generally enclose and cover said portion of said clients hair.

2. A masking sheet as defined in claim 1 wherein said first and second monotonically convex curves comprise first and second substantially semicircular curves.

3. A masking sheet as defined in claim 1 wherein said first and second monotonically convex curves each embodies a mirror symmetry across a longitudinal axis of said masking sheet.

4. A masking sheet comprising:

a substantially flexible material member having a first surface adapted to be disposed adjacent to a portion of a client's hair, said first surface being encompassed by first and second longitudinal edges and first and second transverse edges and contiguous therewithin, said first and second longitudinal edges being substantially rectilinear and substantially parallel to one another, said first and second transverse edges defining respective first and second monotonically concave curves with respect to a transverse centerline of said masking sheet, said first and second transverse edges defining opposite ends, and substantially exhibiting mirror symmetry, across said transverse centerline of said masking sheet, said masking sheet being adapted to be folded along a transverse fold line so as to generally enclose and cover said portion of said clients hair.

* * * * *